US005935709A

United States Patent [19]

Yoshida

[11] Patent Number: 5,935,709

[45] **Date of Patent: *Aug. 10, 1999**

[54] THERMAL TRANSFER RECORDING MATERIAL

[75] Inventor: Katsuhiro Yoshida, Osaka, Japan

[73] Assignee: Fujicopian Co., Ltd., Osaka, Japan

[ * ] Notice: This patent is subject to a terminal disclaimer.

[21] Appl. No.: 08/754,312

[22] Filed: Nov. 21, 1996

[30] Foreign Application Priority Data

Nov. 22, 1995 [JP] Japan ..... 7-304704

[51] Int. Cl.[6] ..... B41M 5/26

[52] U.S. Cl. ..... 428/413; 428/195; 428/323; 428/327; 428/422; 428/913; 428/914

[58] Field of Search ..... 428/413, 195, 428/421, 422, 484, 488.1, 323, 327, 913, 914

[56] References Cited

U.S. PATENT DOCUMENTS

| | | | |
|---|---|---|---|
| 5,328,754 | 7/1994 | Yuyama et al. . | |
| 5,658,667 | 8/1997 | Yoshida et al. | 428/195 |
| 5,714,249 | 2/1998 | Yoshida et al. | 428/195 |
| 5,741,583 | 4/1998 | Yoshida | 428/484 |
| 5,773,149 | 6/1998 | Yoshida et al. | 428/195 |

FOREIGN PATENT DOCUMENTS

| | | | |
|---|---|---|---|
| 0 696 517 A1 | 2/1996 | European Pat. Off. | B41M 5/38 |
| 0 761 462 A1 | 3/1997 | European Pat. Off. | B41M 5/38 |
| 02204093 | 8/1990 | Japan | B41M 5/30 |
| WO 94/25282 | 11/1994 | WIPO | B41M 5/38 |

OTHER PUBLICATIONS

WPI Database, Section Ch, Week 9442, Derwent Publications Ltd., London, GB; Class A28, AN 94–337928, XP002048562 & JP 06 262 859 A (Toppan Printing Co. Ltd); Sep. 20 1994.

*Primary Examiner*—Pamela R. Schwartz
*Attorney, Agent, or Firm*—Fish & Neave

[57] ABSTRACT

A thermal transfer recording material comprising a foundation and a heat-meltable ink layer provided on the foundation, the heat-meltable ink layer comprising a heat-meltable vehicle and a coloring agent, the heat-meltable vehicle comprising at least one epoxy resin selected from the group consisting of tetraphenolethane tetraglycidyl ether, cresol novolac polyglycidyl ether, bisphenol A diglycidyl ether and bisphenol F diglycidyl ether, and a low melt viscosity substance, the epoxy resin and the low melt viscosity substance accounting for 50 to 95% by weight and 5 to 50% by weight, respectively, of the overall heat-meltable vehicle. The recording material exhibits satisfactory transferability and gives printed images having excellent scratch resistance.

8 Claims, 1 Drawing Sheet

THERMAL TRANSFER RECORDING MATERIAL

BACKGROUND OF THE INVENTION

The present invention relates to thermal transfer recording materials providing printed images having excellent fastness.

Conventional thermal transfer recording materials, in general, include those comprising a foundation and, applied onto the foundation, a heat-meltable ink containing a vehicle composed mainly of a wax or another type of heat-meltable ink containing a vehicle composed mainly of a resin for ensuring printed images of good quality even on paper sheets having relatively poor surface smoothness or printed images of high scratch resistance.

Recently, bar code printers and label printers using thermal transfer recording materials have been used to print bar codes or like codes for management of parts or products in production processes of manufacturing factories, merchandise management in the distribution field, management of articles at using sites, and the like. When used in, for example, the distribution field, bar codes are frequently scratched or rubbed. Therefore, such bar codes must have particularly high scratch resistance.

As well as for the printing of bar codes, thermal transfer printers have been used in the production of diversified products in small quantities, including outdoor advertising materials, election posters, common posters, standing signboards, stickers, catalogs, pamphlets, calenders and the like in the commercial printing field; bags for light packaging, labels of containers for foods, drinks, medicines, paints and the like, and binding tapes in the packaging field; and labels for indicating quality characteristics, labels for process control, labels for product management and the like in the apparel field. These articles are also required to exhibit good scratch resistance.

With the conventional thermal transfer recording materials using the heat-meltable ink containing a vehicle composed mainly of a wax, however, resulting printed images exhibit poor scratch resistance though the ink enjoys satisfactory transferability. On the other hand, with the conventional thermal transfer recording materials using the heat-meltable ink containing a vehicle composed mainly of a resin such as ethylene-vinyl acetate copolymer, the transferability of the ink is inferior to the former ink due to its relatively high melt viscosity though resulting printed images enjoy relatively high scratch resistance.

It is, therefore, an object of the present invention to provide a thermal transfer recording material which is capable of exhibiting satisfactory transferability while at the same time forming printed images having excellent scratch resistance.

The foregoing and other objects of the present invention will be apparent from the following detailed description.

SUMMARY OF THE INVENTION

According to the present invention, there is provided a thermal transfer recording material comprising a foundation and a heat-meltable ink layer provided on the foundation, the heat-meltable ink layer comprising a heat-meltable vehicle and a coloring agent, the heat-meltable vehicle comprising at least one epoxy resin selected from the group consisting of tetraphenolethane tetraglycidyl ether, cresol novolac polyglycidyl ether, bisphenol A diglycidyl ether and bisphenol F diglycidyl ether, and a low melt viscosity substance, the epoxy resin and the low melt viscosity substance accounting for 50 to 95% by weight and 5 to 50% by weight, respectively, of the overall heat-meltable vehicle.

In an embodiment of the present invention, the heat-meltable ink layer further contains a particulate polytetrafluoroethylene, the content of the particulate polytetrafluoroethylene in the heat-meltable ink layer being from 1 to 60% by weight.

In another embodiment of the present invention, the heat-meltable ink layer further contains a compatibilizer.

In still another embodiment of the present invention, the heat-meltable ink layer further contains a particulate wax, and the total content of the particulate wax and the particulate polytetrafluoroethylene in the heat-meltable ink layer is from 1 to 60% by weight.

In a further embodiment of the present invention, the thermal transfer recording material further comprises an ink-protecting layer interposed between the foundation and the heat-meltable ink layer, the ink-protecting layer comprising a particulate polytetrafluoroethylene and a binder resin.

In still further embodiment of the present invention, the thermal transfer recording material further comprises a layer comprising a wax interposed between the foundation and the ink-protecting layer, the wax layer having a penetration of not higher than 1.

In the present invention, the term "heat-meltable" in the heat-meltable ink layer and heat-meltable vehicle is intended to include both a condition that the vehicle is melted when the ink is transferred and another condition that the vehicle is not melted but softened when the ink is transferred.

DETAILED DESCRIPTION

Figure 1:
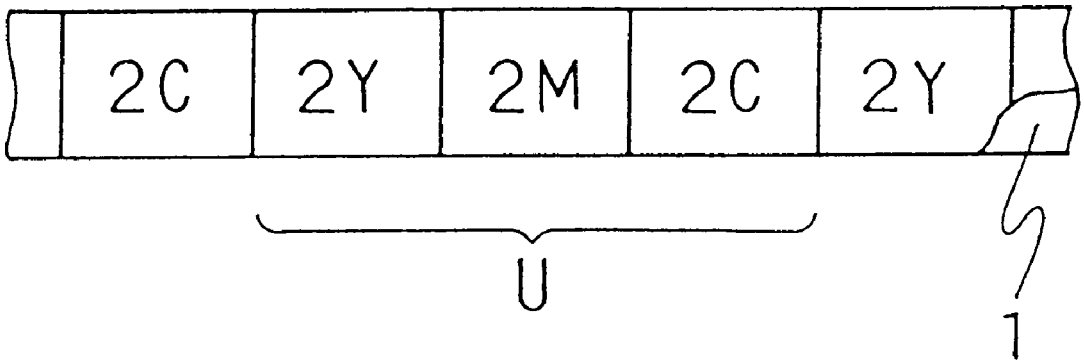
FIG. 1 is a partial plan view showing an example of an arrangement of color ink layers of respective colors in an embodiment of the thermal transfer recording material of the present invention.

The present invention will now be described in detail.

In the present invention, the heat-meltable ink layer comprises a heat-meltable vehicle and a coloring agent, the heat-meltable vehicle comprising at least one epoxy resin selected from the group consisting of tetraphenolethane tetraglycidyl ether, cresol novolac polyglycidyl ether, bisphenol A diglycidyl ether and bisphenol F diglycidyl ether, and a low melt viscosity substance, the epoxy resin and the low melt viscosity substance accounting for 50 to 95% (% by weight, hereinafter the same) and 5 to 50%, respectively, of the overall heat-meltable vehicle.

The use of the above-specified epoxy resin as a main component of the vehicle for a heat-meltable ink provides a heat-meltable ink having excellent transferability and giving printed images with excellent scratch resistance.

The combination use of the above-specified epoxy resin and the low melt viscosity substance further improves the transferability of the ink. That is, the combination use lowers the melt viscosity of the ink when being transferred and, hence, provides good adhesion of the ink to a receptor, resulting in good transferability.

The specified epoxy resins to be used in the present invention are tetraphenolethane tetraglycidyl ether, cresol novolac polyglycidyl ether, bisphenol A diglycidyl ether and bisphenol F diglycidyl ether. These epoxy resins can be used either singly or in combination of two or more species thereof.

Tetraphenolethane tetraglycidyl ether (hereinafter referred to as "TPETGE" as the need arises) as aforementioned is a species of polyfunctional epoxy resins and represented by formula (I):

(I)

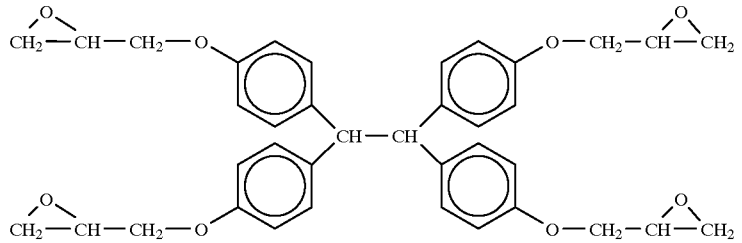

TPETGE has a softening point of about 92° C.

Cresol novolac polyglycidyl ether (hereinafter referred to as "CNPGE" as the need arises) as aforementioned is a species of polyfunctional epoxy resins. In the present invention preferred examples of CNPGEs include those represented by formula (II):

(II)

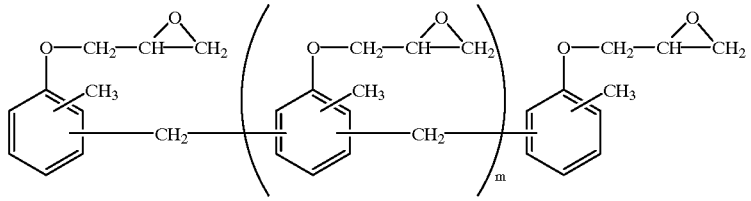

wherein m is usually an integer of from 3 to 7. CNPGEs usable in the present invention include mixtures of those of formula (II) wherein values for m are different from each other. CNPGE preferably has a softening point of 60° to 120° C.

Bisphenol A diglycidyl ether (hereinafter referred to as "BPADGE" as the need arises) is a species of difunctional epoxy resins. Preferred are those represented by formula (III):

(III)

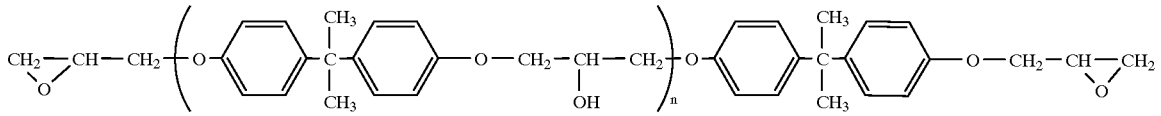

wherein n is usually an integer of from 0 to 13. BPADGEs usable in the present invention include mixtures of those of formula (III) wherein values for n are different from each other. BPADGE preferably has a softening point of 60° to 140° C.

Bisphenol F diglycidyl ether (hereinafter referred to as "BPFDGE" as the need arises) is a species of difunctional epoxy resins. Preferred are those represented by formula (IV):

(IV)

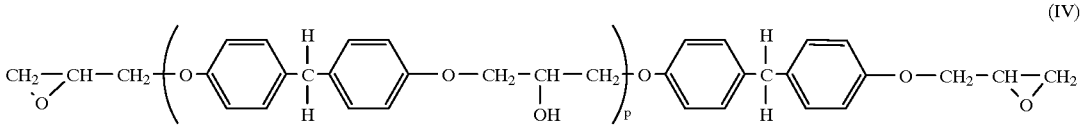

wherein p is usually an integer of from 0 to 33. BPFDGEs usable in the present invention include mixtures of those of formula (IV) wherein values for p are different from each other. BPFDGE preferably has a softening point of 60° to 140° C.

The low melt viscosity substance is preferably a substance capable of lowering the melt viscosity of the above-specified epoxy resin. The low melt viscosity substance itself preferably has a lower melt viscosity than that of the above-specified epoxy resin, and has a melt viscosity of 0.1 to 30 poises at 130° C., especially 0. 1 to 1 poise at 130° C. When the melt viscosity of the low melt viscosity substance is higher than the above range, the effect due to the combination use of the epoxy resin and the substance is not favorably exhibited. When the melt viscosity of the low melt viscosity substance is lower than the above range, the smudging of the receptor is apt to occur. Further, the low melt viscosity substance preferably has good compatibility with the above-specified epoxy resin.

In view of the foregoing, the preferred low melt viscosity substances are epoxy resins having a low melt viscosity. Examples of such epoxy resins having a low melt viscosity are tetramethylbiphenyl diglycidyl ether, biphenyl diglycidyl ether and triglycidyl isocyanurate. These epoxy resins can be used either singly or in combination of two or more species thereof.

A substance having a melt viscosity outside the above melt viscosity range can also be used. It is desirable that such substance is used together with another low melt viscosity substance so that the resulting mixture has a melt viscosity within the above melt viscosity range.

Preferable as the above-mentioned tetramethylbiphenyl diglycidyl ether (hereinafter referred to as "TMBPDGE" as the need arises) are those represented by formula (V):

(V)

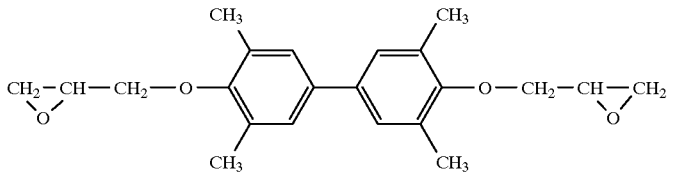

The above-mentioned biphenyl glycidyl ether (hereinafter referred to as "BPDGE" as the need arises) is represented by formula (VI):

(VI)

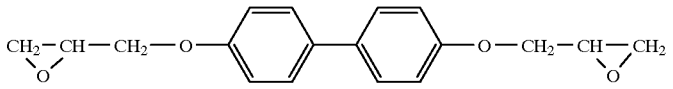

The above-mentioned triglycidyl isocyanurate (hereinafter referred to as "TGIC" as the need arises) is represented by formula (VII):

(VII)

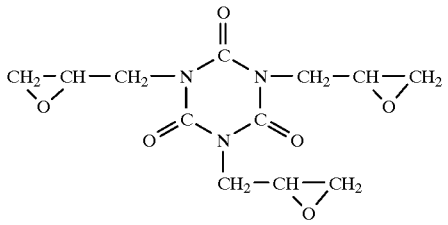

In the present invention, the softening point and melting point are values measured with a differential scanning calorimeter DSC 210 made by Seiko Instruments Inc. The softening point and melting point are measured at a temperature rising rate of 10° C. /min. The melt viscosity is measured with Soliquid Meter MR-300 made by Rheology Co. Ltd.

In the present invention it is particularly desirable that the epoxy resin component is entirely composed of at least one of the above-specified epoxy resins. It is, however, not necessarily required to do so, and an epoxy resin component containing not less than 50%, preferably not less than 70% of at least one of the four specified epoxy resins can exhibit the desired effects with respect to transferability, scratch resistance, and the like. If the proportion of such specified epoxy resin in the overall epoxy resin component is less than the foregoing range, poor dispersibility of a pigment in the heat-meltable vehicle will result, thus deteriorating the transferability of the ink.

In the present invention, it is preferable that the above-specified epoxy resin and the low melt viscosity substance are contained in an amount of 50 to 95%, particularly 65 to 90%, and in an amount of 5 to 50%, particularly 10 to 35%, respectively, of the overall heat-meltable vehicle. When the proportion of the above-specified epoxy resin is less than the above range, the resulting printed images are apt to have poor fastness. When the proportion of the above-specified epoxy resin is more than the above range, the resulting ink is apt to provide poor transferability. When the proportion of the low melt viscosity substance is less than the above range, the above-mentioned transferability-improving effect is not satisfactorily exhibited. When the proportion of the low melt viscosity substance is more than the above range, the smudging of the receptor is apt to sometimes occur.

The epoxy resin component can contain an epoxy resin other than the above-specified epoxy resin.

Examples of epoxy resins usable in combination with the aforementioned specified epoxy resins are, for example, brominated bisphenol A diglycidyl ether, brominated bisphenol F diglycidyl ether, hydrogenated bisphenol A diglycidyl ether, and naphthol-modified cresol novolac polyglycidyl ether. When these other epoxy resins are used, they can be used either singly or in combination of two or more species thereof. The other epoxy resin preferably has a softening point of not lower than 60° C.

The other epoxy resin is preferably used in an amount of not greater than 47.5%, more preferably not greater than 15%, especially not greater than 5%, based on the total amount of the vehicle.

The vehicle may be incorporated with one or more heat-meltable resins other than the epoxy resin component so long as the purpose of the present invention is attained. Examples of such heat-meltable resins include ethylene-vinyl acetate copolymer resin, ethylene-alkyl (meth)acrylate copolymer resin, phenolic resin, copolymer resin of styrene and acrylic monomer, polyester resin and polyamide resin. Such heat-meltable resins are used in an amount of preferably not greater than 15%, more preferably not greater than 5% based on the total amount of the vehicle.

The softening point of the vehicle is preferably within the range of from 60° to 120° C. in terms of the storage stability and transferability of the thermal transfer recording material.

The content of the vehicle in the heat-meltable ink layer is preferably from 40 to 95%, more preferably from 60 to 90% in terms of the transferability and like properties of the ink layer.

Further the heat-meltable ink layer of the present invention is preferably incorporated with a particulate polytetrafluoroethylene (hereinafter referred to as "PTFE"). The heat-meltable ink layer wherein the particulate PTFE is dispersed in the epoxy resin as a vehicle offers an improved separability when being transferred. Further, since particles of PTFE appear on the surface of printed images, the printed images enjoy improved scratch resistance. Herein, the term "separability of a heat-meltable ink layer" means the property that when being transferred, the heated portion of a heat-meltable ink layer is easily separated from the unheated portion of the heat-meltable ink layer and only the heated portion is transferred onto a receptor to give a sharp print image.

In the present invention, the PTFE may be either a homopolymer of tetrafluoroethylene or a copolymer of tetrafluoroethylene and a small quantity of a monomer for modification.

The particulate PTFE preferably has an average particle diameter of 0.01 to 15 μm, more preferably 0.01 to 5 μm. If the average particle diameter of the particulate PTFE is smaller than the above range, the resulting printed images are prone to have unsatisfactorily enhanced scratch resistance. If the average particle diameter of the particulate PTFE is greater than the above range, the heat-meltable ink layer is prone to be poor in transferability.

The content of the particulate PTFE in the heat-meltable ink layer is preferably from 1 to 60%, more preferably from 5 to 30%. If the content of the particulate PTFE is lower than the above range, the effect of improving the scratch resistance of printed images is not sufficiently exhibited. If the content of the particulate PTFE is higher than the above range, the heat-meltable ink layer is prone to be poor in transferability.

The particulate PTFE can be used in the form of either bulk, or a dispersion or emulsion in an organic solvent or aqueous solvent (including water).

In the present invention, the particulate PTFE is preferably used in combination with a particulate wax, resulting in printed images with further improved scratch resistance.

The particulate wax preferably has an average particle diameter of 0.01 to 15 μm, more preferably 0.01 to 5 μm. If the average particle diameter of the particulate wax is smaller than the above range, the resulting printed images are prone to have unsatisfactorily enhanced scratch resistance. If the average particle diameter of the particulate wax is greater than the above range, the heat-meltable ink layer is prone to be poor in transferability.

In the combination use of the particulate PTFE and the particulate wax, the total content of both in the heat-meltable ink layer is preferably from 1 to 60%, more preferably 5 to 30%. If the total content of the particulate PTFE and wax is lower than the above range, the effect of improving the scratch resistance of printed images is not sufficiently exhibited. If the total content of the particulate PTFE and wax is higher than the above range, the heat-meltable ink layer is prone to be poor in transferability.

In the combination use of the particulate PTFE and the particulate wax, the proportion of the particulate PTFE is preferably from 50 to 90%, more preferably from 50 to 70% based on the total amount of the particulate PTFE and wax. If the proportion of the particulate PTFE is smaller than the above range, the resulting printed images are sometimes a little poor in oil resistance. If the proportion of the particulate PTFE is more than the above range, the effect of improving the scratch resistance of printed images is sometimes not sufficiently exhibited.

Examples of the particulate wax are those formed from, either alone or in combination, vegetable waxes such as carnauba wax, candelilla wax and rice wax; animal waxes such as bees wax and lanolin; mineral waxes such as montan wax and ceresin wax; petroleum waxes such as paraffin wax and microcrystalline wax; and synthetic hydrocarbon waxes such as Fischer-Tropsch wax, polyethylene wax, oxidized polyethylene wax, polypropylene wax and oxidized polypropylene wax. These particulate waxes may be used either alone or in combination of two or more species. Particularly preferable among the above particulate waxes are those formed from polyethylene wax, oxidized polyethylene wax, polypropylene wax, oxidized polypropylene wax, Fischer-Tropsch wax and carnauba wax in terms of good slip properties of their particle surfaces.

The particulate wax can be used in the form of either bulk, or a dispersion or emulsion in an organic solvent or aqueous solvent (including water).

When the particulate PTFE is incorporated in the heat-meltable ink layer, the ink layer is preferably further incorporated with a compatibilizer. The incorporation of the compatibilizer results in the formation of microdomains in the interface between particles of PTFE and the epoxy resin, thereby enhancing the affinity and adhesion therebetween.

Useful as the compatibilizer are epoxy resins having a perfluoroalkyl group having 6 to 10 carbon atoms. Any epoxy resins mentioned above as the vehicle component can be used as the base epoxy resin for the compatibilizer. The amount of the compatibilizer is preferably 0.1 to 30%, more preferably 0.5 to 15%, based on the amount of the overall epoxy resin as the vehicle.

Useful as the coloring agent in the present invention are various organic and inorganic pigments as well as carbon black. Examples of such organic and inorganic pigments include azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments, titanium white, calcium carbonate and barium sulfate. Such pigments may be used in combination with dyes for adjusting the color of the ink layer. The content of the coloring agent in the ink layer is preferably from 5 to 60%, more preferably from 10 to 40%.

Yellow, magenta and cyan coloring agents, and optionally black coloring agents are used for forming multi-color or full-color printed images utilizing subtractive color mixture.

The coloring agents for yellow, magenta and cyan for use in the ink layer are preferably transparent pigments, while the coloring agents for black are usually opaque pigments.

Examples of transparent yellow pigments include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG, Quinoline Yellow Lake and Disazo Yellow. These pigments may be used either alone or in combination of two or more species thereof.

Examples of transparent magenta pigments include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y, Arizalin Lake and Quinacridone Red. These pigments may be used either alone or in combination of two or more species thereof.

Examples of transparent cyan pigments include organic pigments such as Victoria Blue Lake, metal-free Phthalocyanine Blue, Phthalocyanine Blue and Fast Sky Blue. These pigments may be used either alone or in combination of two or more species thereof.

The term "transparent pigment" means a pigment which gives a transparent ink when dispersed in a transparent vehicle.

Examples of black pigments include inorganic pigments having insulating or conductive properties such as carbon black, and organic pigments such as Aniline Black. These pigments may be used either alone or in combination of two or more species thereof.

In the present invention the heat-meltable ink layer may be incorporated with appropriate additives such as dispersing agents as well as the aforementioned ingredients.

The heat-meltable ink layer can be formed by applying onto a foundation a coating liquid prepared by dissolving the epoxy resin in a solvent which is capable of dissolving the epoxy resin or dispersing the epoxy resin in a solvent which is incapable of dissolving the epoxy resin, and then dissolving or dispersing the coloring agent and the low melt viscosity substance, and optionally the particulate PTFE (or the particulate PTFE and wax) together with other additives, followed by drying.

The coating amount (on a solid basis, hereinafter the same) of the heat-meltable ink layer in the present invention is usually from 0.02 to 5 $g/m^2$, preferably from 0.5 to 3 $g/m^2$.

As the foundation for the thermal transfer recording material of the present invention, one can use polyester films such as polyethylene terephthalate film, polybutylene terephthalate film, polyethylene naphthalate film, polybutylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the foundation of ink ribbons of this type. Alternatively, thin paper sheets of high density such as condenser paper can also be used. The thickness of the foundation is usually from about 1 to about 10 $\mu$m. From the standpoint of reducing heat spreading to increase the resolution of printed images, the thickness of the foundation is preferably from 1 to 6 $\mu$m.

Where the thermal transfer recording material of the present invention is to be used in a thermal transfer printer with a thermal head, a conventionally known stick-preventive layer is preferably provided on the back side (the side to be brought into slide contact with the thermal head) of the foundation. Examples of materials for the stick-preventive layer include various heat-resistant resins such as silicone resins, fluorine-containing resins and nitrocellulose resins, and other resins modified with these heat-resistant resins such as silicone-modified urethane resins and silicone-modified acrylic resins, and mixtures of the foregoing heat-resistant resins and lubricating agents.

In a preferred embodiment of the present invention, an ink-protecting layer is provided between the foundation and the heat-meltable ink layer. After being transferred, the ink-protecting layer exists on the top surface of printed images, resulting in further improved scratch resistance.

The ink-protecting layer is preferably composed of a particulate PTFE. Useful as the particulate PTFE are those for the heat-meltable ink layer. A binder resin is preferably used in the ink-protecting layer to enhance the strength of the ink-protecting layer itself. Acrylic resins are preferably used as the binder resin from the viewpoint of improving the scratch resistance of printed images.

In the case of using the binder resin, the proportions of the particulate PTFE and the binder resin are preferably from 97 to 70% and from 3 to 30%, respectively, based on the total amount of the ink-protecting layer.

The ink-protecting layer is preferably further incorporated with a particulate wax besides the particulate PTFE. Useful as the particulate wax are those for the heat-meltable ink lyer.

When using the particulate PTFE and the particulate wax in combination, a binder resin, particularly acrylic resin is preferably used to enhance the strength of the ink-protecting layer itself. In that case, the proportions of the particulate PTFE, the particulate wax and the binder resin are preferbly from 35 to 65%, 5 to 35% and 3 to 30%, respectively, based on the total amount of the ink-protecting layer.

Examples of the acrylic resins as the binder resin are polymethyl methacrylate, polymethyl acrylate, polyethyl methacrylate, polyethyl acrylate, polybutyl methacrylate, polybutyl acrylate, and copolymers thereof. These acrylic resins can be used either alone or in combination of two or more species thereof.

The particulate PTFE for the ink-protecting layer is preferably used in the form of a dispersion, particularly a solvent dispersion. In preparation of such a dispersion, a fluorine-containing surface active agent is preferably used as a dispersing agent to achieve a good dispersibility. Useful as the fluorine-containing surface active agent are high-molecular-weight fluorine-containing surface active agents. Examples of the high-molecular-weight fluorine-containing surface active agents are acrylic resins containing perfluoroalkyl group (preferably having 6 to 10 carbon atoms), and copolymers of acrylic monomer and ethylene oxide containing perfluoroalkyl group (preferably having 6 to 10 carbon atoms). Such a high-molecular-weight fluorine-containing surface active agent also serves as the binder resin and, hence, can be used as the whole quantity or a portion of the binder resin.

The coating amount of the ink-protecting layer is preferably from 0.3 to 2 g/m$^2$, more preferably from 0.5 to 1.5 g/m$^2$. When the coating amount of the ink-protecting layer is smaller than the above range, the ink-protecting effect is prone to be insufficiently exhibited. When the coating amount of the ink-protecting layer is larger than the above range, the transferability is prone to be degraded.

The ink-protecting layer can be formed by applying onto the foundation or the wax layer mentioned below a coating liquid which is composed of a dispersion (including an emulsion, hereinafter the same) of the particulate PTFE or prepared by mixing the particulate PTFE or a mixture of the particulate PTFE and wax with a dispersion or solution of the binder resin, followed by drying.

In another preferred embodiment of the present invention, a wax layer having a penetration of not more than 1 is provided between the foundation and the ink-protecting layer. The wax layer facilitates the release of the ink-protecting layer from the foundation when being transferred, resulting in excellent transferability.

Examples of the wax for the wax layer are carnauba wax, polyethylene wax, and the like. These waxes may be used either alone or in combination of two or more species thereof.

The wax layer can be formed by applying onto the foundation a solvent solution, solvent dispersion or aqueous emulsion of the wax, followed by drying. The wax layer can also be formed by a hot melt coating method.

The coating amount of the wax layer is usually from 0.01 to 2.0 g/m$^2$, preferably from 0.1 to 1.0 g/m$^2$. When the coating amount of the wax layer is smaller than the above range, the desired effect is prone to be insufficiently exhibited. When the coating amount of the wax layer is larger than the above range, the transferability is prone to be degraded.

The term "thermal transfer recording material" as used herein means to include a thermal transfer recording material for forming monochromatic images, and a thermal transfer recording material for forming multi-color or full-color images utilizing subtractive color mixture.

The thermal transfer recording material for forming monochromatic images is of a structure in which a monochromatic heat-meltable ink layer is provided on a foundation (or an ink-protecting layer). Colors for the monochromatic heat-meltable ink layer include black, red, blue, green, yellow, magenta and cyan.

An embodiment of the thermal transfer recording material for forming multi-color or full-color images is of a structure in which on a single foundation (or the ink-protecting layer thereon) are disposed a yellow heat-meltable ink layer, a magenta heat-meltable ink layer and a cyan heat-meltable ink layer and, optionally, a black heat-meltable ink layer in a side-by-side relation. Such color ink layers can be disposed in various manners on a foundation depending on the kind of printer.

FIG. 1 is a partial plan view showing an example of the thermal transfer recording material according to the foregoing embodiment. As shown in FIG. 1, on a single foundation 1 are disposed a yellow heat-meltable ink layer 2Y, a magenta heat-meltable ink layer 2M and a cyan heatmeltable ink layer 2C in a side-by-side relation. These ink layers 2Y, 2M and 2C, each having a predetermined constant size, are periodically disposed longitudinally of the foundation 1 in recurring units U each comprising ink layers 2Y, 2M and 2C arranged in a predetermined order. The order of arrangement of these color ink layers in each recurring unit U can be suitably determined according to the order of transfer of the color ink layers. Each recurring unit U may comprise a black ink layer in addition to the layers 2Y, 2M and 2C.

Another embodiment of the thermal transfer recording material for forming multi-color or full-color images is a set of thermal transfer recording materials comprising a first thermal transfer recording material having a yellow heat-meltable ink layer on a first foundation (or the ink-protecting layer thereon), a second thermal transfer recording material having a magenta heat-meltable ink layer on a second foundation (or the ink-protecting layer thereon), and a third thermal transfer recording material having a cyan heat-meltable ink layer on a third foundation (or the ink-protecting layer thereon), and, optionally a fourth thermal transfer recording material having a black heat-meltable ink layer on a fourth foundation (or the ink-protecting layer thereon).

The use of any of the foregoing embodiments of the thermal transfer recording materials will give multi-color or full-color images having excellent scratch resistance. Further, individual color heat-meltable ink layers in the present invention are excellent in superimposing properties, thus ensuring multi-color or full-color images of superior color reproducibility.

To form printed images using the thermal transfer recording material of the present invention the ink layer is superimposed on an image-receiving body and heat energy is applied imagewise to the ink layer. A thermal head is typically used as a heat source of the heat energy. Alternatively, any conventional heat sources can be used such as laser light, infrared flash and heat pen.

Where the image-receiving body is not a sheet-like material but a three-dimensional article, or one having a curved surface, thermal transfer method using laser light is advantageous since application of heat energy is easy.

The formation of multi-color or full-color images using the thermal transfer recording material of the present invention is performed, for example, as follows. With use of a thermal transfer printer with one or plural thermal heads the yellow ink layer, the magenta ink layer and the cyan ink layer are selectively melt-transferred onto a receptor in a predetermined order in response to separation color signals of an original multi-color or full-color image, i.e., yellow signals, magenta signals and cyan signals to form yellow ink dots, magenta ink dots and cyan ink dots on the receptor in a predetermined order, thus yielding a yellow separation image, a magenta separation image and a cyan separation image superimposed on one another on the receptor. The order of transfer of the yellow ink layer, magenta ink layer and cyan ink layer can be determined as desired. When a usual multi-color or full-color image is formed, all the three color ink layers are selectively transferred in response to the corresponding three color signals to form three color separation images on the receptor. When there are only two color signals, the corresponding two of the three color ink layers are selectively transferred to form two color separation images.

Thus there is obtained a multi-color or full-color image comprising: (A) at least one region wherein a color is developed by subtractive color mixture of at least two superimposed inks of yellow, magenta and cyan, or (B) a combination of the region (A) and at least one region of a single color selected from yellow, magenta and cyan where different color inks are not superimposed. Herein a region where yellow ink dots and magenta ink dots are present in a superimposed state develops a red color; a region where yellow ink dots and cyan ink dots are present in a superimposed state develops a green color; a region where magenta ink dots and cyan ink dots are present in a superimposed state develops a blue color; and a region where yellow ink dots, magenta ink dots and cyan ink dots are present in a superimposed state develops a black color. A region where only yellow, magenta or cyan ink dots are present develops a yellow, magenta or cyan color.

In the above manner a black color is developed by the superimposing of yellow ink dots, magenta ink dots and cyan ink dots. A black color may otherwise be obtained by using only black ink dots instead of three color ink dots. Further alternatively, a black color may be obtained by superimposing black ink dots on at least one of yellow, magenta and cyan ink dots, or on superimposed ink dots of at least two of yellow, magenta and cyan ink dots.

In forming printed images with use of the thermal transfer recording material, the printed images may be directly formed on a final object, or alternatively by previously forming the printed images on a sheet-like image-receiving body (receptor) and then bonding the image-receiving body thus bearing the printed images to a final object with suitable means such as an adhesive.

The present invention will be more fully described by way of Examples and Comparative Examples. It is to be understood that the present invention is not limited to these Examples, and various changes and modifications may be made in the invention without departing from the spirit and scope thereof.

EXAMPLES 1–17 AND COMPARATIVE EXAMPLES 1–5

A 5 $\mu$m-thick polyethylene terephthalate film was formed on one side thereof with a stick-preventive layer composed of a silicone resin with a coating amount of 0.25 g/m$^2$. Onto the opposite side of the polyethylene terephthalate film with respect to the stick-preventive layer was applied an ink coating liquid of the formula shown in Table 1, followed by drying at 70° C. to form a heat-meltable ink layer with a coating amount of 2 g/m$^2$, yielding a thermal transfer recording material.

It should be noted that in Table 1 the average particle diameter of particles was measured using a laser diffraction particle size distribution measuring apparatus, SALD-1100 available from SHIMADZU CORPORATION (hereinafter the same).

In Examples 11 to 14, a coating liquid for a wax layer of the formula shown in Table 2 was applied onto the foundation and dried at 70° C. to form a wax layer with a coating amount of 0.3 g/m$^2$ and a penetration of not higher than 1, followed by the formation of the ink-protecting layer as mentioned below. The penetration was measured at 25° C. by a penetration measuring method provided in JIS K 2235.

In Examples 9 to 14, a coating liquid for an ink-protecting layer of the formula shown in Table 2 was applied onto the foundation (Examples 9 and 10) or the wax layer (Examples 11 to 14) and dried at 70° C. to form an ink-protecting layer with a coating amount of 0.5 g/m$^2$, followed by the formation of the heat-meltable ink layer.

TABLE 1

| Formula of ink | Ex. No. | | | | | | | | | | | | | | | | | Com. Ex. No. | | | | |
|---|---|---|---|---|---|---|---|---|---|---|---|---|---|---|---|---|---|---|---|---|---|---|
| coating liquid (%) | 1 | 2 | 3 | 4 | 5 | 6 | 7 | 8 | 9 | 10 | 11 | 12 | 13 | 14 | 15 | 16 | 17 | 1 | 2 | 3 | 4 | 5 |
| Epikote 1031S *1 | 12 | 11 | 10 | 9 | | | | | 8 | 8 | 8 | 8 | 8 | 8 | 8 | 8 | 8 | | | | | |
| Epikote 1003 *2 | | | | | 6.9 | | | | | | | | | | | | | 14 | 13.9 | 4 | 3 | 5 |
| Araldite ECN1280 *3 | | | | | | 6 | | | | | | | | | | | | | | | | |
| Epikote 4007P *4 | | | | | | | 5 | 6 | | | | | | | | | | | | | | |
| EOCN-7000 *5 | | | | | | | | 4 | | | | | | | | | | | | | 9 | |
| YX-4000 *6 | 2 | 1 | 1 | 3 | | | | | 4 | 4 | 4 | 4 | 4 | | 4 | 4 | 4 | | | | | 7 |
| YL-6121H *7 | | | | | | | | | | | | | | 4 | | | | | | | | |
| TEPIC-S *8 | | | | | 6.8 | | | | | | | | | | | | | | | | | |
| TEPIC-P *9 | | | | | | 2 | | | | | | | | | | | | | | | | |
| TEPIC-G *10 | | | | | | | | 2 | | | | | | | | | | | | | | |
| Araldite PT 810 *11 | | | | | | | 1 | | | | | | | | | | | | | | | |
| PTFE particle A *12 | 2 | 2 | 1 | | | | | 2 | 2 | 2 | 2 | 2 | 2 | 2 | 2 | 2 | 2 | | | | | |
| PTFE particle B *13 | | | | | 0.3 | | | | | | | | | | | | | | | | | |
| PTFE particle C *14 | | | | | | 6 | | | | | | | | | | | | | | | | |
| PTFE particle D *15 | | | | | | | 11 | | | | | | | | | | | | 0.1 | 13 | 2 | 2 |
| HIGH FLAT 7328 *16 | | | | 6 | | | | | | | | | | | | | | | | | | |
| Compatibilizer *17 | | | 1 | | | | | | | | | | | | | | | | | | | |
| Carbon black | 6 | 6 | 6 | 6 | 6 | 6 | 3 | 6 | 6 | 6 | 6 | 6 | 6 | 6 | | | | 6 | 6 | 3 | 6 | 6 |
| Yellow pigment *18 | | | | | | | | | | | | | | | 6 | | | | | | | |
| Magenta pigment *19 | | | | | | | | | | | | | | | | 6 | | | | | | |
| Cyan pigment *20 | | | | | | | | | | | | | | | | | 6 | | | | | |
| Methyl ethyl ketone | 48 | 48 | 48 | 43 | 48 | 48 | 48 | 48 | 48 | 48 | 48 | 48 | 48 | 48 | 48 | 48 | 48 | 48 | 48 | 48 | 48 | 48 |
| Toluene | 32 | 32 | 32 | 32 | 32 | 32 | 32 | 32 | 32 | 32 | 32 | 32 | 32 | 32 | 32 | 32 | 32 | 32 | 32 | 32 | 32 | 32 |

*1 TPETGE made by Yuka Shell Epoxy Kabushiki Kaisha, softening point: 92° C., melt viscosity: 90 poises/130° C.
*2 BPADGE made by Yuka Shell Epoxy Kabushiki Kaisha, softening point: 89° C., melt viscosity: 50 poises/130° C.
*3 CNPGE made by Asahi-CIBA Limited, softening point: 80° C., melt viscosity: 40 poises/130° C.
*4 BPFDGE made by Yuka Shell Epoxy Kabushiki Kaisha, softening point: 109° C., melt viscosity: 47 poises/130° C.
*5 Naphthol-modified cresol novolac polyglycidyl ether made by Nippon Kayaku Co., Ltd., softening point: 90° C. melt viscosity: 43 poises/130° C.
*6 TMBPDGE made by Yuka Shell Epoxy Kabushiki Kaisha, melting point: 105° C. melt viscosity: 0.3 poise/130° C.
*7 A mixture of BPDGE and TMBPDGE (1:1 by weight) made by Yuka Shell Epoxy Kabushiki Kaisha, melting point: 130° C., melt viscosity: 0.2 poise/130° C.
*8 TGIC (low chlorine content product) made by Nissan Chemical Industries, Ltd., melting point: 95° C., melt viscosity: 0.4 poise/130° C.
*9 TGIC (general grade powdery product) made by Nissan Chemical Industries, Ltd., melting point: 90° C., melt viscosity: 0.5 poise/130° C.

TABLE 1-continued

| Formula of ink | Ex. No. | | | | | | | | | | | | | | | | | Com. Ex. No. | | | | |
|---|---|---|---|---|---|---|---|---|---|---|---|---|---|---|---|---|---|---|---|---|---|---|
| coating liquid (%) | 1 | 2 | 3 | 4 | 5 | 6 | 7 | 8 | 9 | 10 | 11 | 12 | 13 | 14 | 15 | 16 | 17 | 1 | 2 | 3 | 4 | 5 |

*10 TGIC (general grade granular product) made by Nissan Chemical Industries, Ltd., melting point: 90° C., melt viscosity: 0.5 poise/130° C.
*11 TGIC made by Asahi-CIBA Limited, melting point: 90° C., melt viscosity: 0.4 poise/130° C.
*12 Average particle diameter: 0.3 μm
*13 Average particle diameter: 3.0 μm
*14 Average particle diameter: 5.0 μm
*15 Average particle diameter: 10.0 μm
*16 15% Dispersion of oxidized polyethylene wax (average particle diameter: 3 μm, m.p.: 120° C.) in methyl ethyl ketone, made by GIFU SHELLAC MFG. CO., LTD.
*17 Epoxy resin containing perfluoroalkyl group having 6 to 10 carbon atoms
*18 C.I. Pig. No. Y-12 made by Sanyo Color Works, Ltd.
*19 C.I; Pig. No. R-122 made by Sanyo Color Works, Ltd.
*20 C.I. Pig. No. B-15-2 made by Sanyo Color Works, Ltd.

TABLE 2

| Ex. No. | 9 | 10 | 11 | 12 | 13 | 14 |
|---|---|---|---|---|---|---|
| Coating liquid for wax layer (%) | | | | | | |
| Carnauba wax emulsion (solid content 30%) | | 33 | 33 | 33 | 33 | |
| Methanol | | 67 | 67 | 67 | 67 | |
| Coating liquid for ink-protecting layer (%) | | | | | | |
| PTFE particle A | 9.5 | 4.5 | 9.5 | 4.5 | 4.5 | 4.5 |
| HIGH FLAT 7328 | | 30.0 | | 30.0 | 30.0 | 30.0 |
| Polymethyl methacrylate (number average molecular weight: $18 \times 10^4$) | | 1.0 | | 1.0 | 1.0 | 1.0 |
| Dispersing agent for PTFE particles* | 0.5 | 0.5 | 0.5 | 0.5 | 0.5 | 0.5 |
| Toluene | 90 | 64.0 | 90 | 64.0 | 64.0 | 64.0 |

*High-molecular-weight fluorine-containing surface active agent which is a copolymer of an acrylic monomer and ethylene oxide containing perfluoroalkyl group having 6 to 10 carbon atoms Using each of the thermal transfer recording materials thus obtained, printing was performed to print bar code patterns on a receptor (available from Lintech Corp. under the commercial name "Silver Namer") with a thermal transfer type bar code printer (B-30 made by TEC Corp.) under the following conditions:

Applied energy: 19.8 mJ/mm$^2$

Printing speed: 2 inches/second

Platen pressure: "High" in terms of an indication prescribed in the printer

Note that the receptor used herein comprised a polyester film having on one side thereof an aluminum deposition layer and a pressure-sensitive adhesive layer thereon and was adapted to receive printed images on the polyester film surface thereof.

The resulting printed images were evaluated for their transferability and scratch resistance (crocking resistance and smear resistance).

The results are shown in Table 3.

Transferability

Using a bar code reader (Codascan II produced by RJS ENTERPRISES, INC), the printed images were subjected to a reading test according to the following judgment criteria:

A: completely readable;

B: almost completely readable;

C: readable without any practical problem;

D: partially readable; and

E: impossible to read.

Scratch Resistance (Crocking Resistance)

The printed images were rubbed under the following conditions and then subjected to the reading test as above.

Tester: A.A.T.C.C. Crock Meter Model CM-1 produced by ATLAS ELECTRIC DEVICE COMPANY Rubbing material: Cotton cloth Pressure: 500 g/cm$^2$ Number of reciprocations: 300

Scratch Resistance (Smear Resistance)

The printed images were rubbed under the following conditions and then subjected to the reading test as above.

Tester: Rub Tester produced by Yasuda Seiki Seisakusho Ltd.

Rubbing material: Corrugated fiberboard

Pressure: 250 g/cm$^2$

Number of reciprocations: 300

TABLE 3

| | Transferability | Crocking Resistance | Smear resistance |
|---|---|---|---|
| Ex.1 | B | B | C |
| Ex.2 | B | B | C |
| Ex.3 | B | B | C |
| Ex.4 | B | B | C |
| Ex.5 | B | B | C |
| Ex.6 | B | B | C |
| Ex.7 | B | B | C |
| Ex.8 | B | B | C |
| Ex.9 | B | B | B |
| Ex.10 | B | B | B |
| Ex.11 | A | A | A |
| Ex.12 | A | A | A |
| Ex.13 | A | A | A |
| Ex.14 | A | A | A |
| Ex.15 | B | B | C |
| Ex.16 | B | B | C |
| Ex.17 | B | B | C |
| Com. Ex.1 | B | D | D |
| Com. Ex.2 | B | D | D |
| Com. | E | E | E |

TABLE 3-continued

| | Transferability | Crocking Resistance | Smear resistance |
|---|---|---|---|
| Ex.3 | | | |
| Com. Ex.4 | D | D | D |
| Com. Ex.5 | D | E | E |

As seen from the foregoing, the thermal transfer recording material of the present invention offers excellent transferability and provides printed images exhibiting high scratch resistance and hence is useful in printing images such as bar codes.

In addition to the materials and ingredients used in the Examples, other materials and ingredients can be used in the present invention as set forth in the specification to obtain substantially the same results.

What I claim is:

1. A thermal transfer recording material comprising a foundation and a heat-meltable ink layer provided on the foundation, the heat-meltable ink layer comprising a heat-meltable vehicle and a coloring agent, the heat-meltable vehicle comprising at least one epoxy resin selected from the group consisting of tetraphenolethane tetraglycidyl ether, cresol novolac polyglycidyl ether, bisphenol A diglycidyl ether and bisphenol F diglycidyl ether, and a low melt viscosity substance, wherein the low melt viscosity substance comprises at least one epoxy resin selected from the croup consisting of tetramethylbiphenyl diglycidyl ether, biphenyl diglycidyl ether and triglycidyl isocyanurate, the epoxy resin and the low melt viscosity substance accounting for 50 to 95% by weight and 5 to 50% by weight, respectively, of the overall heat-meltable vehicle.

2. The thermal transfer recording material of claim 1, wherein the heat-meltable ink layer further contains a particulate polytetrafluoroethylene, the content of the particulate polytetrafluoroethylene in the heat-meltable ink layer being from 1 to 60% by weight.

3. The thermal transfer recording- material of claim 2, wherein the heat-meltable ink layer further contains a compatibilizer.

4. The thermal transfer recording material of claim 2, wherein the heat-meltable ink layer further contains a particulate wax, and the total content of the particulate wax and the particulate polytetrafluoroethylene in the heat-meltable ink layer is from 1 to 60% by weight.

5. The thermal transfer recording material of claim 1, wherein the low melt viscosity substance has a melt viscosity of 0.1 to 30 poises at 130° C.

6. The thermal transfer recording material of claim 1, which further comprises an ink-protecting layer interposed between the foundation and the heat-meltable ink layer, the ink-protecting layer comprising a particulate polytetrafluoroethylene and a binder resin.

7. The thermal transfer recording material of claim 6, wherein the ink-protecting layer further contains a particulate wax besides the particulate polytetrafluoroethylene.

8. The thermal transfer recording material of claim 6, which further comprises a layer comprising a wax interposed between the foundation and the ink-protecting layer, the wax layer having a penetration of not higher than 1.

* * * * *

UNITED STATES PATENT AND TRADEMARK OFFICE

CERTIFICATE OF CORRECTION

PATENT NO : 5,935,709

DATED : August 10, 1999

INVENTION(S) : Katsuhiro Yoshida

It is certified that error appears in the above-identified patent and that said Letters Patent is hereby corrected as shown below:

Column 5, line 10 delete "0 .1" and substitute therefor -- 0.1 --.

Column 16, Table 1, line 16 delete "120°" and substitute therefor -- 102° --.

Column 17, line 31 delete "croup" and substitute therefor -- group --.

Signed and Sealed this

Sixteenth Day of January, 2001

*Attest:*

*Attesting Officer*

Q. TODD DICKINSON

*Commissioner of Patents and Trademarks*